US007109879B2

(12) United States Patent
Stults et al.

(10) Patent No.: US 7,109,879 B2
(45) Date of Patent: Sep. 19, 2006

(54) REMOTELY ACTIVATED, MULTIPLE STAGE ALARM SYSTEM

(75) Inventors: Larry W. Stults, Cary, NC (US); Brent E. Routman, Minnetonka, MN (US); Jeremy P. Shapiro, Shaker Heights, OH (US); Nicholas P. Johns, Minneapolis, MN (US)

(73) Assignee: Smart Safety Systems, Inc., Minnetonka, MN (US)

( * ) Notice: Subject to any disclaimer, the term of this patent is extended or adjusted under 35 U.S.C. 154(b) by 0 days.

(21) Appl. No.: 10/695,590

(22) Filed: Oct. 28, 2003

(65) Prior Publication Data

US 2004/0145465 A1 Jul. 29, 2004

Related U.S. Application Data

(60) Provisional application No. 60/441,114, filed on Jan. 17, 2003.

(51) Int. Cl.
*G08B 3/00* (2006.01)

(52) U.S. Cl. ..... 340/691.1; 340/286.06; 340/552; 340/561; 340/628; 340/632; 340/693.6

(58) Field of Classification Search ..... 340/691, 340/407.1, 7.6, 693.6, 539.1, 539.11, 546, 340/552, 628, 632, 286.06, 286.07, 286.08, 340/692, 693.5, 286.05, 573.1, 551, 561, 340/691.1

See application file for complete search history.

(56) References Cited

U.S. PATENT DOCUMENTS 4,093,944 A 6/1978 Muncheryan
5,309,146 A 5/1994 Kenet
5,423,327 A * 6/1995 Clauson et al. ..... 600/322

(Continued)

FOREIGN PATENT DOCUMENTS

DE 200 19 560 U1 2/2001

OTHER PUBLICATIONS

Shapiro, Bill, *Patented By Parents*, Parenting (magazine), May 1996 p. 28.

(Continued)

*Primary Examiner*—Davetta W. Goins
(74) *Attorney, Agent, or Firm*—Charles L. Warner, II; Powell Goldstein LLP

(57) ABSTRACT

An alarm system (100) to wake sleeping occupants in the event of an emergency has a receiver (105) for detecting a warning signal (130) emitted from an external device (125), such as a smoke or carbon monoxide detector. A processor (11) compares the received warning signal to a predetermined signal and, if they correspond, then a transmitter (115) transmits an alarm (135). The predetermined signal can be preprogrammed or it can be learned by alarm system. The alarm is at least one of an audible, visual, vibratory, and/or olfactory communication. A customized audible communication in a voice familiar to the occupants can be recorded and stored in the alarm system. In addition, the system may provide different alarms before and after motion is detected.

103 Claims, 5 Drawing Sheets

U.S. PATENT DOCUMENTS

| | | | | |
|---|---|---|---|---|
| 5,656,612 | A * | 8/1997 | Monia | 514/44 |
| 5,737,692 | A * | 4/1998 | Lang | 455/66.1 |
| 5,767,786 | A | 6/1998 | Lopatukhin et al. | |
| 5,867,105 | A * | 2/1999 | Hajel | 340/691.3 |
| 5,907,279 | A * | 5/1999 | Bruins et al. | 340/506 |
| 6,028,513 | A * | 2/2000 | Addy | 340/539.16 |
| 6,052,052 | A | 4/2000 | Delmonaco | |
| 6,097,288 | A | 8/2000 | Koeppe, Jr. | |
| 6,384,724 | B1 | 5/2002 | Landais | |
| 6,411,207 | B1 * | 6/2002 | Shaffer | 340/521 |
| 6,661,345 | B1 * | 12/2003 | Bevan et al. | 340/575 |
| 6,762,686 | B1 * | 7/2004 | Tabe | 340/573.1 |
| 6,768,424 | B1 * | 7/2004 | Morris | 340/628 |
| 6,838,994 | B1 * | 1/2005 | Gutta et al. | 340/575 |
| 2001/0043144 | A1 | 11/2001 | Morris | |
| 2003/0179090 | A1 | 9/2003 | Morris | |
| 2003/0229500 | A1 | 12/2003 | Morris | |
| 2004/0135699 | A1 | 7/2004 | Salzhauer et al. | |
| 2004/0137959 | A1 | 7/2004 | Salzhauer et al. | |

OTHER PUBLICATIONS

Paradigm Enterprises, Inc., *New Device "Scent of Life" Can Save Lives*, advertisement.

Shackleford, Chris, *The Scent of Life Saves Lives*, Chattanooga Free Press (newspaper); Nov. 21, 1995.

*AwaKID*, Internet Web Page found at http://www.awakid.com/productoverview.html.

*AwaKID*, Internet Web Page found at http://www.awakid.com/media.html.

EPO Search Report, Mar. 17, 2006, Stults, et al.

Tenelex Industries, Inc., New Device "Scent of Life" Can Save Lives, advertisement.

* cited by examiner

REMOTELY ACTIVATED, MULTIPLE STAGE ALARM SYSTEM

PRIORITY CLAIM

This application claims the priority of U.S. Provisional Patent Application No. 60/441,114 filed Jan. 17, 2003.

TECHNICAL FIELD

The present invention relates to an alarm system that cooperates with an external device, and more particularly to an alarm system that transmits at least one of an audible, visual, vibratory, or olfactory communication in response to receiving a signal from an external device identifying the occurrence of an emergency.

BACKGROUND OF THE INVENTION

Fire, smoke, carbon monoxide, and other home hazards pose significant and ongoing risks to families, individuals, and pets in households across the country and around the world. There is a continuing need to provide more effective safety devices and methods to reduce injuries and death.

One existing problem in need of a better solution is how to quickly awaken sleeping occupants in the event of a household emergency. One approach to this problem is to increase the volume of noise generated by a traditional alarm. However, this is not feasible as a very loud noise volume may result in hearing loss to persons who are close to the alarm. Moreover, irrespective of the volume of the alarm, some recent research suggests that a generic alarm tone is not effective in awakening sleeping individuals, particularly children.

Another approach to the problem of waking sleeping occupants is to move the detector of the emergency condition into the bedrooms and sleeping chambers, so as to better awaken the sleeping occupants therein. However, in this arrangement the advantage of early warning against fire and/or smoke or carbon monoxide by a unit situated outside of such rooms is lost. By the time an alarm in the bedroom detects smoke, fire, or carbon monoxide, it may be too late for the alarm to be effective in avoiding injury or death.

An additional problem exists for people with selective hearing loss. Presently, emergency alarms in the home employ a single frequency alarm or tonal buzzer, which may not adequately be heard by persons having a selective hearing loss or deficiency in that particularly frequency range.

Yet another problem is the tendency for a person in an emergency situation to fail to react quickly, properly, and effectively to the circumstances. A person may become panicked, confused, and/or suffer from loss of focus or concentration, and may not clearly analyze the gravity of the situation and/or understand what action should be taken. Thus, it is all too common that precious and critical time is lost, wrong actions are taken, or even no action is taken.

Finally, many families and individuals will benefit from an easy-to-use safety device. Safety devices that children can understand and readily respond to are more likely to be used by families. This in turn may cause families to discuss safety with household members, make a household safety plan, and practice emergency procedures.

SUMMARY OF THE INVENTION

Recent research only now identifies the problem of the inability of standard smoke detector alarms to awaken sleeping individuals, especially children. It is reasonable to assume that this problem extends to other types of emergency condition detectors, including carbon monoxide detectors and burglary alarms. Current research indicates that recitation of a person's name during sleep may be a more effective means by which to awaken that person, especially a child who is sound asleep. Additionally, this may be particularly true if the person's name is spoken by an individual familiar to the sleeping person (e.g., the sound of a parent calling the child's name).

The present invention provides an alarm system for alerting or waking sleeping occupants during an emergency situation. The alarm system receives a warning signal from an external device, and then a transmitter transmits at least one of an audible communication, a visual communication, or a vibratory communication. In another embodiment, the alarm system receives a warning signal from an external device and determines whether the received warning signal corresponds to a predetermined signal. If the received warning signal corresponds to the predetermined signal, then a transmitter transmits at least one of an audible communication, a visual communication, vibratory communication, or olfactory communication. In either embodiment, the transmitter can transmit a customized, audible communication.

Accordingly, it is an object of the present invention to provide a more effective means of alerting or waking occupants of a structure during an emergency. It should be noted that the term "occupants" includes both persons and animals, including but not limited to dogs and cats. It should also be noted that the term "structure" includes without limitation, residences, nursing homes, apartments, dormitories, hospitals, hotels, schools, offices, or other buildings inhabited by people and/or animals.

It is another object of the present invention to provide an alarm system located in close proximity to an occupant, who may be sleeping, but which alarm system is activated by an external device remote to the occupant.

It is yet another object of the present invention to provide an alarm system that transmits a customized communication in response to receiving a warning signal from an external device.

Further, in situations where it is desirable or necessary to provide the occupant with instructions, the communication may include both a wakeup message and an instructional message. However, in some cases, it may be more beneficial to first wake the occupant, and then provide the occupant with a separate instructional message once it has been determined that the occupant has been awakened. For example, it may be more effective to repeat the child's name while flashing a light until the child has been awakened, and then eliminate the flashing light and provide an instructional message on what to do. Thus, it is yet another object of the present invention to provide a multiple-stage communication.

Other objects, features, and advantages of the present invention will become apparent upon reading the following description of the preferred embodiment, when taken in conjunction with the drawings and claims.

DETAILED DESCRIPTION OF THE INVENTION

Figure 1:
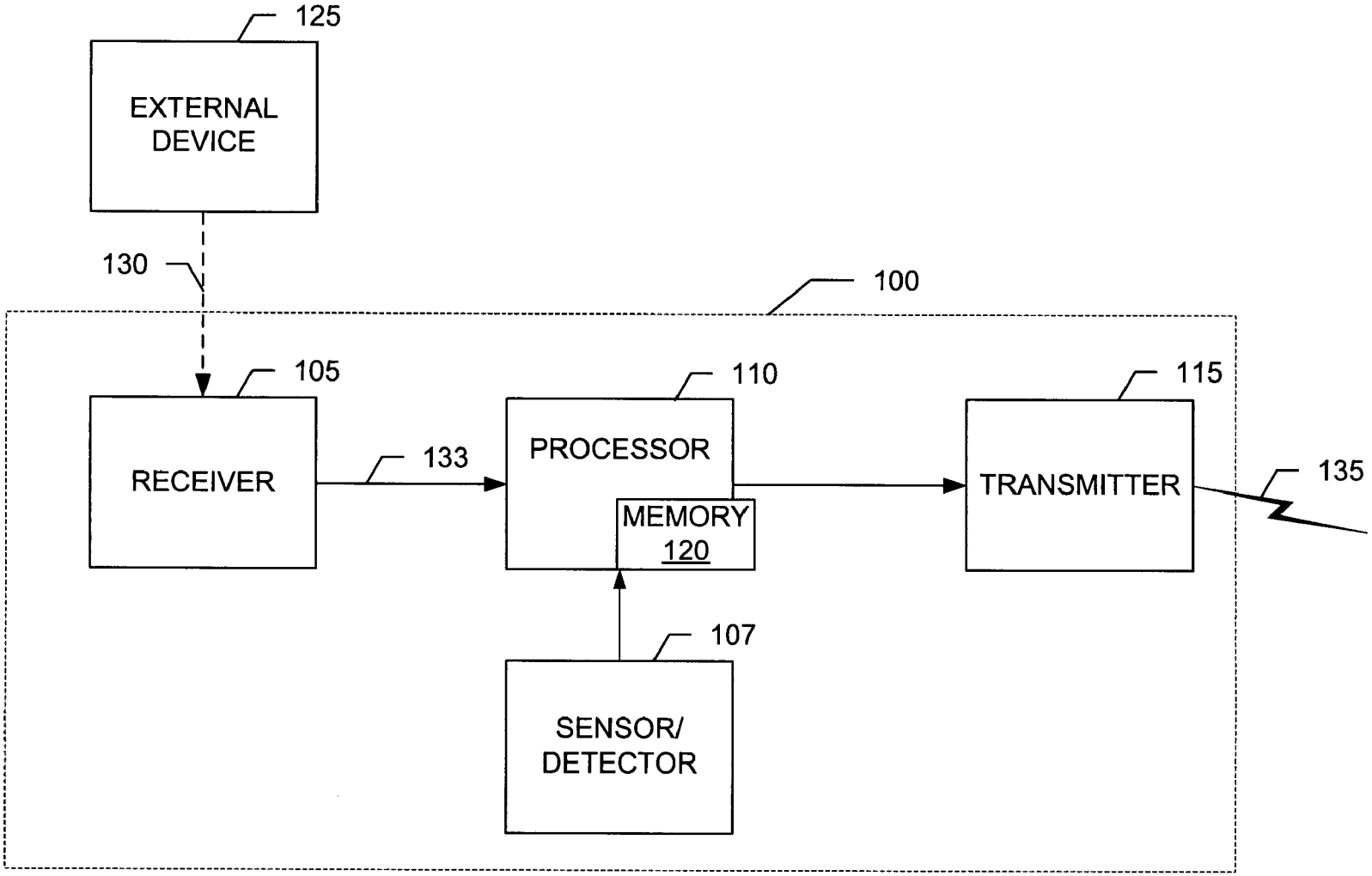
FIG. 1 is a block diagram of the preferred embodiment of the present invention.

Turning now to the drawings, in which like numerals represent like components throughout the several figures, FIG. 1 is a block diagram of the preferred embodiment of an alarm system 100 of the present invention.

Alarm system 100 preferably comprises one or more receivers 105, one or more processors 110, one or more transmitters 115, and one or more sensors/detectors 107. The processor 110 is functionally connected to the receiver 105, the transmitter 115 and the sensor/detector 107. Within or separate from the processor 110 is memory 120. Alarm system 100 can be a portable safety device such that the receiver 105, processor 110, transmitter 115, and sensor/detector 107 are contained within a single device.

External device 125 is a detector or mechanism capable of sensing the presence of an emergency situation or the existence of a threat of injury or death or danger. Examples of such external devices 125 include, but are not limited to, fire and smoke detectors/alarms, such as ionization detectors and photoelectric detectors, carbon monoxide (CO) detectors/alarms, earthquake or vibration detectors/alarms, flood detectors/alarms, motion detectors/alarms, burglary detectors/alarms or other entry or breach of security detectors/alarms, etc. For example, a well-known external device 125 is the common smoke alarm. A smoke alarm includes an emergency condition detector (i.e., circuitry that generates a signal in response to presence of smoke) and an alarm (i.e., circuitry that generates a warning signal 130, such as a tone or a light). Further, a smoke alarm typically includes a simple control feature, such as one or more switches or buttons which allow the user to test, activate, or deactivate the smoke alarm.

In response to sensing the emergency situation or threat, the external device 125 emits a warning signal 130 that can be detected by receiver 105. The warning signal 130 can be audible, such as a loud noise, or visual, such as flashing light, or a tactile sensation, such as a vibration, or an olfactory scent.

Receiver 105 receives the warning signal 130 from the external device 125. The receiver 105 is adapted to be responsive to signals of the type transmitted by the external device 125. The precise structure of the receiver 105 depends upon the external device 125 which is to be monitored for determination of the alarm state. For example, the receiver 105 can operate by attempting to "listen" for an alarm tone generated by the external device 125. In this case, the receiver 105 can include a transducer and a bandpass filter tuned to the frequency emitted by the external device 125. The receiver 105 can also include other functions and/or circuitry, such as a rectifier and lossy integrator coupled to a comparator, which determines whether the bandpass filter is passing a signal of sufficient strength to justify the inference that the external device 125 is emitting an audible warning signal 130. This may be done by hardware, software, or a combination thereof.

For example, if the signal 130 is an audible alarm, receiver 105 may comprise one or more acoustic transducers, such as for example, microphones, or, if the signal 130 is a flashing light, receiver 105 may comprise one or more photodetectors or phototransistors. If the signal 130 is vibratory, receiver 105 may comprise one or more motion or seismic detectors. Seismic detectors, such as, for example, the one disclosed in U.S. Pat. No. 4,358,757 to Perini, are well known in the art. If the signal 130 is a scent or smell, receiver 105 may comprise one or more, olfactory or smell sensors. Smell sensors are well known in the art, and one example is disclosed in U.S. Pat. No. 5,047,214 to Fukui et al. The receiver 105 may also comprise amplifiers, threshold detectors or comparators, filters, and/or integrators. The receiver 105 converts the signal 130 into a signal 133 which is in a form or format which can be used by or operated upon by the processor 110. This may be done by hardware, software, or a combination thereof. Communication of signals 130 between the receiver 105 and the external device 125 can be by any desired means operative in and appropriate to the particular environment. Examples include, but are not limited to, wire or cable, wireless, sound, and light, including visible, laser, ultraviolet and infrared. Additionally, more than one receiver 105 can be used so as to detect one or more of a sound, light, motion, or scent. For example, several receivers 105 can be placed throughout a structure so as to be more responsive to the signal 130. Moreover, one or more external device emergency condition detectors 125 can be combined with one or more receivers 105. External device emergency condition detectors 125 include detectors of smoke, heat, carbon monoxide, radon gas, methane, propane, seismic vibrations, or other dangerous conditions. Once a receiver 105 receives the warning signal 130, the receiver 105 passes the warning signal 130 to the processor 110 as the signal 133.

Although it is preferred that processing of signals is performed by the receiver 105, it will be appreciated that processing may be performed by processor 110, by one or more analog or digital circuits, software, or any desired combination thereof.

Alternatively, alarm system 100 can be networked to an external device 125 and/or to one or more additional alarm systems 100 such that the alarm system 100 is automatically activated when the external device 125 or the additional system 100 is activated. When a plurality of alarm systems 100 are networked, information regarding which alarm system 100 has been activated by a signal 130 from one or more external devices 125 can be communicated to remote alarm systems 100, triggering the transmission of additional communications 135. For example, information such as which room of the building contains the triggering alarm system 100 can be communicated to remote alarm system, thereby initiating appropriate communications 135, such as "Warning—system activated in Bobby's bedroom." Additionally, alarm system 100, in combination with a motion detector 107 (FIG. 3), can communicate information as to whether the occupant of the room is moving. Such communications provide the occupants and others, such as emergency rescue personnel, with information critical for a faster and more focused response, thereby increasing the chance of saving lives and avoiding injury to occupants in need of assistance. The alarm system 100 can also activate other devices. For example, alarm system 100 can activate a telephone or cellular phone that is programmed to call an emergency service and/or the alarm system 100 can activate a sprinkler system.

Processor 110 receives the signal 133 from the receiver 105. Processor 110 is preferably a microprocessor and compares the signal 133 to a predetermined signal stored in its memory 120. If the received warning signal 130, as represented by signal 133, corresponds to the predetermined signal, the processor 110 causes the transmitter 115 to transmit a communication 135. Additionally, a warning signal 130 can be stored by the processor 110 into its memory 120 to become the predetermined signal. In yet another embodiment, once the processor 110 receives signal 133 from receiver 105, the processor 110 causes the transmitter 115 to transmit a communication 135 without comparing the received signal 130 to the predetermined signal. For example, signal 130 can be tested against a decibel threshold, and if the noise is loud enough, then signal 133 causes processor 110 to transmit communication 135. Moreover, communications 135 can be customized and stored by processor 110 into its memory 120.

The alarm system 100 can be located in a region that is remote from the external device 125 as long as the receiver 105 can detect the signal 130. For example, the alarm system 100 can be located in a bedroom, while the external device 125 is located in a kitchen. Per such a scenario, the alarm system 100, located in a bedroom, transmits a communication 135 in response to the external device 125 identifying an emergency condition in the kitchen and transmitting a warning signal 130. Thus, an occupant of the bedroom is alerted to the occurrence of an emergency in the kitchen, such as a fire, before the emergency condition migrates through the house and to the bedroom. This provides additional time for the occupant to escape or take other action, such as determining the nature or cause of the emergency, assisting others, calling for assistance, alerting governmental authorities, etc.

Optionally, to discriminate activating signals from false triggering signals, the warning signal 130 can be a preprogrammed, predetermined signal which external device 125 emits or can be controlled to emit. Alternatively, the warning signal 130 can be learned by the processor 110, such that the user inputs a warning signal 130 from the external device 125 to be stored as the predetermined signal in the memory 120.

A transmitter 115 can transmit one or more audible, visual, vibratory, or olfactory communications 135. Transmitter 115 can be a sound generator, such as a speaker or conventional buzzer, a flashing light generator, a vibration generator, or an olfactory scent generator. Additionally, several different transmitters 115 can be used in combination to provide redundancy or a plurality of communication types. Thus, communications 135 can be one or more of an audible, visual, vibratory, or olfactory communication. Audible communications 135 can include loud noises, such as names, commands, sirens, tones, and other audible communications. Visual communications 135 can include a visible light such as a bright flashing light, such as can be produced by use of a strobe light, halogen light, or xenon discharge light. Olfactory communications 135 can be any distinctive or pungent odor, such as cinnamon, mint, vanilla, hydrogen sulfide, organic esters, other synthesized aromatic compounds, or other pungent or distinctive, preferably nonflammable, odors, released in a suitable manner, such as a mist or an aerosol.

If the communication 135 is a tactile sensation, such as a vibration or vibratory communication 135, then the alarm system 100 would include a mechanism to generate vibratory communications 135. For example, the alarm system 100 may be attached to an object, such as a bed. The vibratory communications 135 can be generated directly via mechanical connection between the alarm system 100 and the article to which it is attached, or indirectly via sound or vibration generated by the alarm system 100 and transmitted to the article via indirect contact with, or close association to, the object.

Communications 135 can be preprogrammed into the memory 120 of the processor 110 such that generic sounds, tones, sirens, sequences of flashing lights, vibrations, and/or scents can be transmitted. Moreover, several different communications 135 can be used in combination with each other. For example, loud noises, flashing lights, and vibrations can be transmitted concurrently or sequentially. Loud noises, such as those of barking dogs, are effective both to awaken people and to gain the attention of household pets. In one embodiment, communication 135 is a non-verbal tone or sound, such as those standard and commonly used in smoke and carbon monoxide detectors.

In another embodiment, communication 135 is an audible customized communication 135 stored in memory 120. The audible customized communication 135 can be a prerecorded vocal message or a synthesized verbal message. Thus, the audible customized communication 135 can be recorded in a voice familiar to the occupants. For example, a user can record the name of an occupant of the house (e.g., a child's name, a spouse's name, a parent's name, or a pet's name) and/or a command (e.g., a command to evacuate the house or to go to the front door) into memory 120. The memory 120 can store more than one vocalized message. For example, the memory device 120 can store a mother's and a father's message to a child. Thus, an audible communication 135 can iteratively instruct a child first in the voice of the child's mother and then in the voice of the child's father ("Reid, wake up (mother's voice) . . . Reid, wake up (father's voice) . . . ").

Moreover, the processor 110 can command transmitter 115 to transmit any combination of communications 135. Thus, alarm system 100 can alternately transmit a person's name followed by one or more tones, sirens, or commands in patterns such as the following: ("Sarah . . . wake up and leave the house . . . Sarah . . . wake up and leave the house"); ("Wake up, Sarah . . . [TONE] . . . Wake up, Sarah [TONE]); ("Sarah . . . [SIREN] . . . Sarah . . . [SIREN]), ("[SIREN] . . . [TONE] . . . [SIREN] . . . [TONE]") ("[SIREN #1] . . . [SIREN #2] . . . [TONE] . . . [SIREN #1]"), etc. Optionally, the processor 110 can individually select the volume at which each of the stored communications 135, or parts of them, are transmitted. For example, it may be preferable to steadily increase the volume until the maximum volume is reached, or to alternate between medium and high volumes, or to say one part of the message at a higher volume, such as the person's name, followed by another part of the message at a lesser volume, such as the instructions on what to do.

In an alternative embodiment, if there are two or more transmitters 115, processor 110 can cause one or more of the transmitters 115 to transmit a different communication 135 than another transmitter 115.

In another alternative embodiment, the communication 135 may be a standard or customized communication which is stored in the transmitter 115. In this embodiment the processor 110 merely instructs the transmitter 115 to begin transmitting its own stored communication message. Of course, a transmitter 115 may have more than one stored communication message so the processor could instruct the transmitter 115 which message or messages to use, or the transmitter 115 could use one or more of them, sequentially or in random order.

Figure 3:
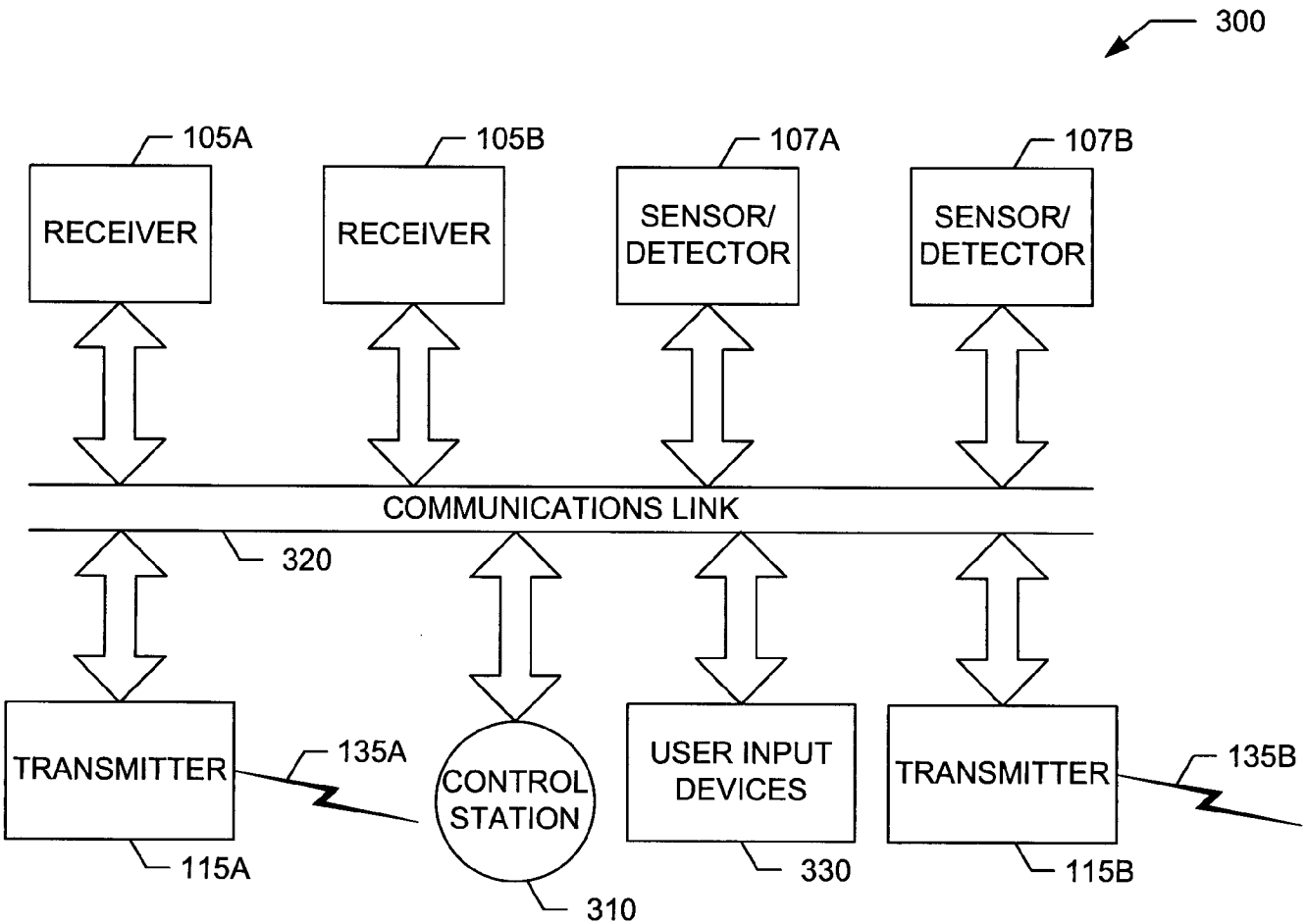
FIGS. 3, 4 and 5 are block diagrams of exemplary alarm systems.
Figure 4:
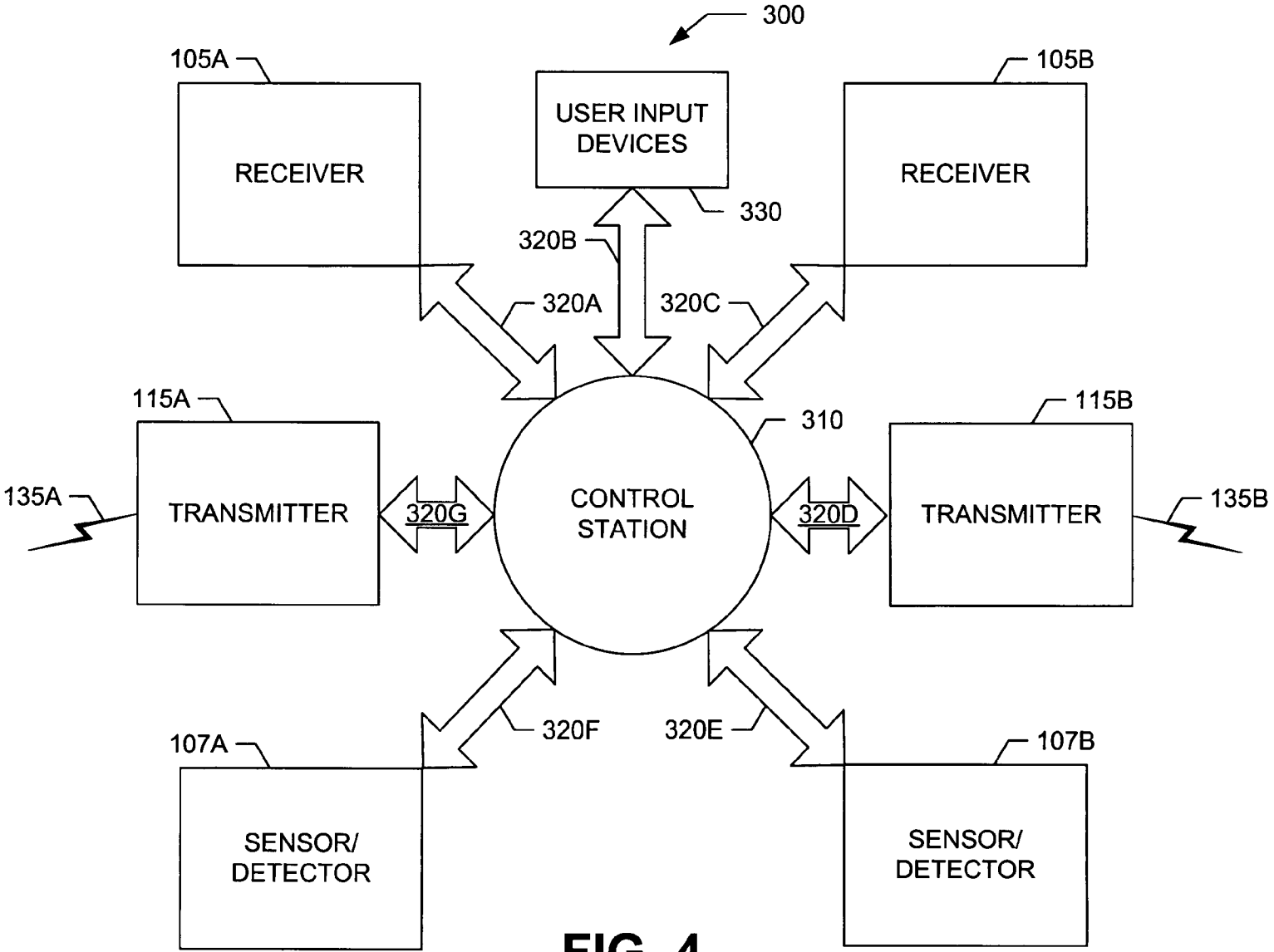
Figure 5:
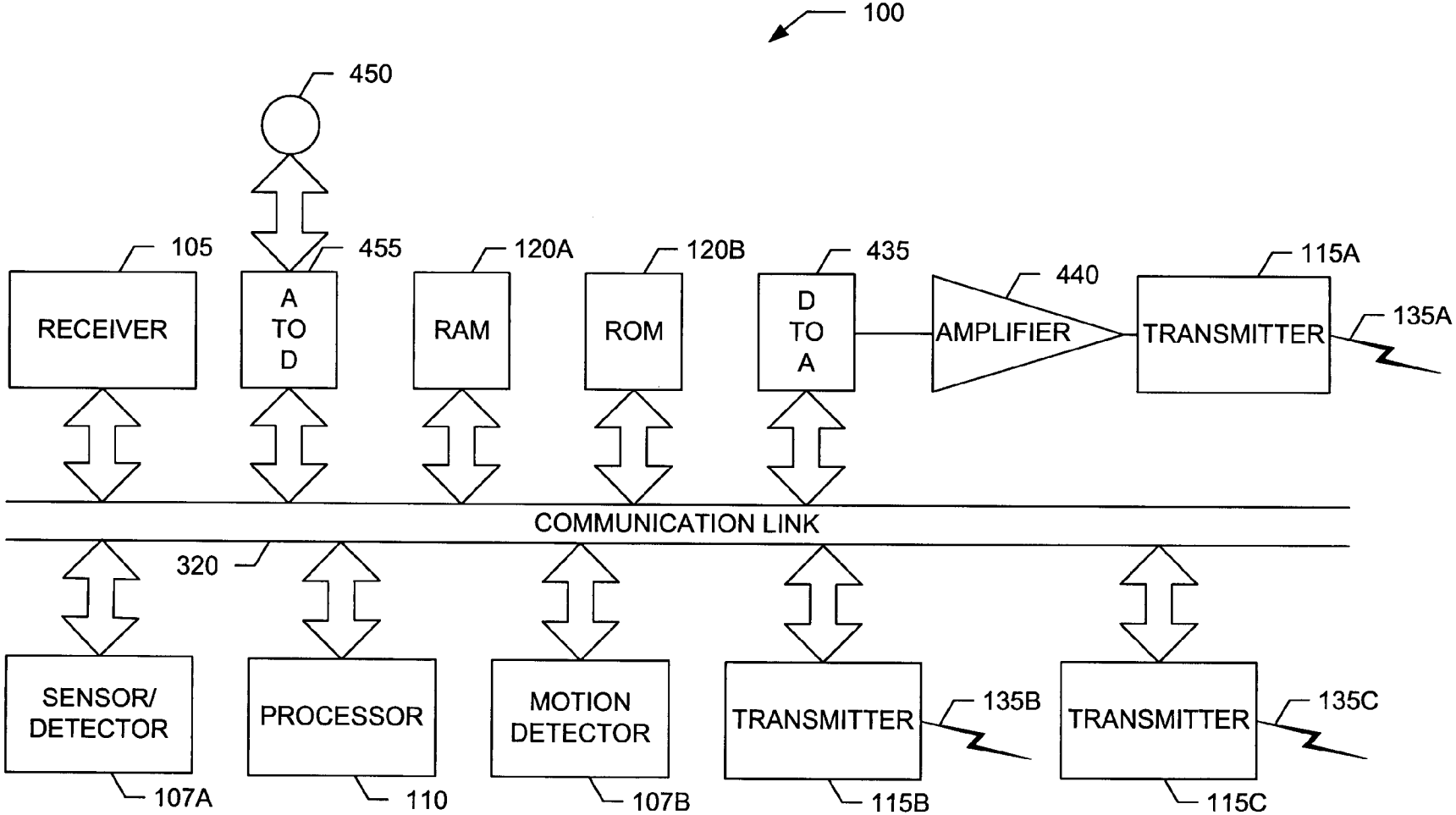

In addition, in another alternative embodiment, the alarm system 100 may have one or more sensors/detectors 107 as shown in more detail in FIGS. 3, 4, and 5.

Optionally, the system may include one or more motion sensors/detectors 107, as more particularly shown in FIG. 5. Sensors/detectors 107 may include detectors of motion, smoke, heat, carbon monoxide, radon gas, methane, propane, seismic vibrations, or other dangerous conditions. If an emergency condition is detected, or an external device sounds an alarm, then if a motion detector 107 is present, the processor 110 can be programmed to cause transmitter 115 to transmit a first communication 135 until motion is detected, thereby indicating that the occupant has awoken, and thereafter transmit a second communication 135. For example, the alarm system 100 can repeatedly vocalize a first audible communication 135 to awaken ("Sarah, wake up . . . Sarah, wake up"). Upon detecting motion, the alarm system 100 can vocalize a second audible communication 135, such as instructing the occupant to leave the dwelling.

The embodiments above are independent, but not mutually exclusive, so two or more of the above embodiments may be used together.

Figure 2:
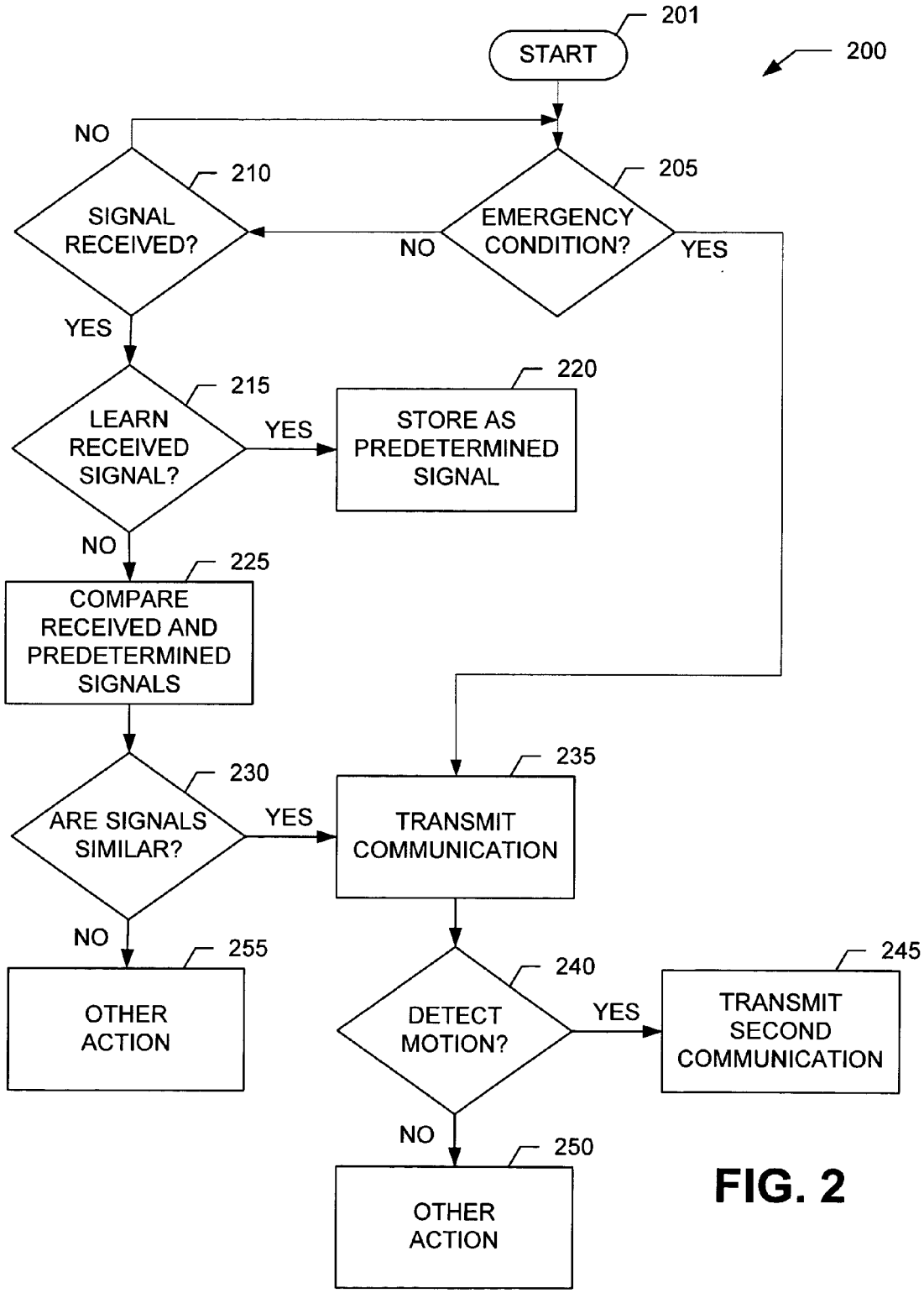
FIG. 2 is a flow chart illustrating a method of remotely triggering an alarm system in accordance with a preferred embodiment of the present invention.

FIG. 2 is a flow chart illustration of a method 200 of operating an alarm system 100 according to a preferred embodiment of the present invention. It will be appreciated that the processor 110 performs or controls most of the steps described herein. The alarm system 100 reacts when a receiver 105 receives a signal or an emergency condition is detected.

Starting at step 201, the system determines 205 whether a sensor/detector 107 has detected an emergency condition. If so, the system proceeds to step 235. If not, the system proceeds to decision 210. Decision 210 determines whether a signal, such as warning signal 130, has been received from an external device, such as external device 125. If not, the system returns to step 201. If so, the system proceeds to step 215.

Step 215 determines whether to learn the received signal. If the processor 110 is in a programmable mode wherein the user has inputted that the received signal is to be learned by the processor 110, the processor 110 at step 220 then stores the received signal as the predetermined signal and then returns to step 205.

If the processor 110 in not in a programmable mode, then the processor 110 compares 225 the received signal to the predetermined signal. Step 230 determines whether the received signal is similar to the predetermined signal. If at decision 230 the received signal differs from the predetermined signal, then some other action is performed 255, which may be just returning to step 205. If the received signal is comparable to the predetermined signal, then the processor 110 proceeds to step 235.

The term "comparing" is used herein in a very broad sense. For example, the step 225 may determine and compare a plurality of factors, such as frequency, frequency variation, amplitude variation, amplitude within or outside of a certain passband, duration, pulse duration, pulse repetition rate, duty cycle, etc. However, the step 225 may also operate very simply, such as determining the presence of a signal having at least a predetermined amplitude. Although the process of comparing is preferably performed by processor 110, it will be appreciated that some or all of that process may be performed by one or more analog or digital circuits.

In step 235, the processor 110 causes the transmitter 115 to transmit a communication 135. After transmitting a communication at step 235, the alarm system 100 may optionally detect motion at step 240. If motion is detected, a second communication 135 can be transmitted at step 245. If motion is not detected, other action is performed at step 250, which action may be that the alarm system 100 continues to transmit a first communication 135 until motion is detected. Or, the alarm system 100 can wait a predetermined amount of time before transmitting a second communication. The alarm system 100 can also increase the volume of an audible communication 135, begin or continue flashing lights, begin or continue vibratory alarms, etc., until motion is detected. It will be appreciated that motion detection may be performed at a different stage. For example, it could be performed before step 235 and determine the communication 135 to be used at step 235. For example, if motion is detected, the first communication 135 may be an instruction to leave the premises, rather than just being an attempt to alert the occupant to the emergency condition.

Thus, the alarm system 100 provides features and benefits not available in the prior art: detection of an alarm signal 130 from a remote sensor or alarm 125, multiple alarm signal types, and multiple alarm signal stages, e.g., before and after motion is detected. These features and benefits are independent, but not mutually exclusive, and can be combined as desired.

FIGS. 3, 4 and 5 depict other exemplary alarm systems 100. As previously mentioned, the alarm system 100 preferably includes one or more receivers 105, one or more emergency condition and/or motion sensors/detectors 107. A sensor/detector 107 performs the same sensing/detection functions as an external device 125 but is part of the alarm system 100 so it may, or may not, also provide an external alarm signal 130.

Additionally, the alarm system 100 preferably includes user input devices 330, such as switches, buttons, etc., that allow a user to control the operation of the alarm system 100, such as activating or deactivating one or more of the receivers 105, sensors/detectors 107, and transmitters 115. User input devices 330 can also include data or communication ports such that other devices, such as personal and portable computers and handheld computing devices, can connect to the alarm system 100 so as to input communications 135 or commands. For example, a user can connect the user input device 330 to a personal computer, and then use the keyboard to type in an occupant's name and instructions to exit the structure, which can then be synthesized into an audible communication 135, as described herein.

The control station 310 comprises a processor 110 and memory 120. The user input devices 330 may be part of, or may be separate from, the control station 310. Additionally, the user input devices 330 can connect to the control station 310, or the user input devices 330 can connect directly to the alarm system 100.

The receivers 105, sensors/detectors 107, and transmitters 115 can be dispersed throughout a structure to ensure the desired coverage throughout the structure. The receivers 105 operate as previously described and communicate with the control station 310. The detectors 107 operate in well-known manners and also communicate with the control station 310. In the event of an emergency or other alarm condition detected by one or more of receivers 105 and/or detectors 107 the control station 310 commands one or more of the transmitters 115 to transmit a communication 135. Optionally, any component 105, 115 or 107 can communicate directly with any other component 105, 115 or 107.

According to one embodiment of the present invention, the alarm system 100 can be embodied as a transmitter 115 that is integrated into the external device 125. Per such an embodiment, the receiver 105 within the alarm system 100 includes communication and control circuitry that permits the alarm system 100 to receive data indicating the occurrence of an emergency. For example, the receiver 105 can include a network card.

The control station 310 communicates via a communications link 320 with the receivers 105, sensors/detectors 107, transmitters 115, and user input devices 330. The communication link 320 may be wired and/or wireless, as desired and appropriate under the particular circumstances.

FIG. 3 depicts an alarm system 100 which has a communications link 320 wherein all of the devices are on a common link, such as a common data bus or data channel.

FIG. 4 depicts an alarm system 100 which has a plurality of communications links 320A–320G, wherein each device is on a separate link, such as an independent data bus or data channel.

Of course, a combination of communications techniques may be used so that some devices are connected via a common link as in FIG. 3, and other devices are connected via independent links, such as in FIG. 4. The selection of the particular communications link 320 to be used is a design choice and will depend upon the circumstances of the particular installation. Regardless of the communications link 320 design used, the control station 310 can communicate individually with each device, and may use different communications protocols for each device.

FIG. 5 depicts a block diagram of another exemplary alarm system 100. The alarm system 100 includes a processor 110, such as a microprocessor 110, which communicates via a communications link 320, which may be a data bus, with a volatile memory device 120A, such as a random access memory (RAM), and a non-volatile memory device 120B, such as a read only memory (ROM), flash card memory, rewritable CD, DVD or other disk, floppy disk, hard drive, etc. The read only memory device 120B stores firmware used for running the device. Optionally, the firmware can be transferred from the non-volatile memory device 120B to the volatile memory device 120A at power-up, or upon reset, etc.

The memory 120 can be used to store a digitized representation of one or more communications 135. These digitized sounds can be restored to analog form via a digital-to-analog converter 435. The analog signal yielded therefrom can be amplified or otherwise conditioned by an amplifier circuit 440. The signal is transduced to an audible form 135 via a transmitter 115, such as a speaker.

The digitized representation of sounds can be pre-programmed into the memory 120. For example, the memory 120 can store a set of digitized vocalization of common names, commands, or messages. The alarm system 100 may include a transducer 450, such as a microphone 450, coupled to an analog-to-digital converter 455, which transducer and associated circuitry may be the same as, part of, or independent of, a receiver 105. The analog-to-digital converter 455 can communicate with the processor 110 via the communications link 320. Accordingly, a user of the alarm system 100 can recite a message, such as the name of an occupant of the house (e.g., a child's name, a spouse's name, an elderly parent's name, or a pet's name) or a command (e.g., a command to evacuate the house) into the microphone 450. The microphone 450 converts the vocalization into an analog electric signal, which is converted to a digital signal by the analog-to-digital converter 455. The microprocessor 110 receives the digitized signal from the analog-to-digital converter 455 and writes the signal into the memory 120. One skilled in the art understands that many potential memory schemes exist. For example, the digitized vocalizations can be stored in a cache memory located on-board the microprocessor 110 and can be stored later in a flash memory device 120B.

As previously mentioned, the processor 110 can optionally and individually select the volume at which each of the stored audible communications 135 is emitted. For example, the amplifier 440 can be controlled by a gain selection signal that is generated by the processor 110. Further, the microprocessor can be programmed to permit a user to determine the volume at which each of the stored audible communications 135 is set.

Per one embodiment of the present invention, the alarm system 100 transmits a first audible communication 135 followed by a second audible communication 135. For example, the first audible communication 135 can be a name of an occupant and a command to awaken, while the second audible communication 135 can be a command to evacuate. ("Flynn, wake up . . . leave the house and meet in our special place . . . Flynn, wake up . . . leave the house and meet in our special place"). Optionally, the volume of each audible communication 135 can be individually selected by the processor 110. For example, the processor 110 can be programmed to play the first audible communication 135 (i.e., the vocalization of the occupant's name and the command to awaken) at a relatively high volume, while the second audible communication 135 (i.e., the command to evacuate) at a lesser volume.

As previously mentioned, the alarm system 100 may include a motion sensor/detector 107 in communication with the processor 110. The processor 110 can be programmed to cause transmitter 115 to transmit a first communication 135 until motion is detected by the motion sensor/detector 107 (indicating that the occupant has awoken), and thereafter transmit a second communication 135. For example, the alarm system 100 can repeatedly vocalize a first audible communication 135 to awaken ("Sarah, wake up . . . Sarah, wake up"). Upon detecting motion, the alarm system 100 can vocalize a second audible communication 135, such as instructing the occupant to leave the dwelling.

Per yet another embodiment of the invention, the alarm system 100 can lack a receiver 105, but instead can possess only an emergency condition sensor/detector 107. The processor 110 can be programmed to transmit any of the communications 135 described herein in response to detection of an emergency condition.

The alarm system 100 can use two transmitters 115 to transmit an audible communication 135 simultaneously with transmitting a visual communication 135 and/or vibratory communication 135. For example, the alarm system 100 can both emit an audible communication 135 and flash a strobe light or shake a bed.

Per yet another embodiment, the memory 120 can store elemental vocal sounds which can be combined to form words. Thus, a user can input vocal communications in the form of data, such as a typed sentence, into or via the user input device 330. The microprocessor 110 can then generate a complete vocal sequence from the elemental vocal sounds, so as to create a synthesized audible communication 135. The synthesized audible communication 135 can be stored in the memory 120 for later replay (as when an emergency state has been detected). In this embodiment the alarm system 100 comprises a mechanism for the user to record a message, and a mechanism for the alarm system 100 to play back the recorded message when the alarm system 100 is activated upon sensing that a remote detector has detected an emergency condition. The recording and playback aspect can be analog, for example a magnetic tape such as a cassette tape mechanism, or it can be digital. Thus, for example, a user can use an input device such as a keyboard, handheld computing device equipped with an infrared transmitter, or a microphone to record a sentence into memory 120 via the receiver 105 and processor 110. For example, the sentence typed in may be "Reid, wake up." A complete vocal pattern is constructed from the elemental vocal patterns stored in the memory 120, and is stored in its complete form. Upon occurrence of an emergency, the sentence is vocalized as described above. Alternatively, the alarm system 100 can include any synthesizer unit known in the art. Further, the user input may be directly into the transmitter 115, rather than into the memory 120 or the processor 110, so that each transmitter 115 stores and recalls the communication with respect to its own memory (not shown).

Preferably, but not necessarily, the alarm system 100 is programmed to require an access code to permit reprogramming of communications 135 or warning signals 130. This reduces the likelihood that a child or some other person will change the settings, programming, or messages. The access code can be a numeric sequence, a sequence of button pushes, or any other suitably complex set of inputs to the processor 110.

It is understood that any of the features recited herein can be combined with any other feature and/or embodiment presented herein. Thus, for example, it is understood that synthesis of vocal communications 135 can be combined with an embodiment including a motion sensor/detector 107 and an emergency condition sensor/detector 107. Additionally, a plurality of audible communications 135 and/or other communications 135 can be stored in memory 120, any of which can be transmitted at any volume selected by the microprocessor 110.

One skilled in the art understands that any of the integrated circuits (i.e., memory devices 120A and 120B, converters 435 and 455, and processor 110) can be combined into a single integrated circuit. Further, the alarm system 100 can be designed to implement the functionality described herein with an application specific integrated circuit, which uses logic to implement such functionality rather than software/firmware. Additionally, one skilled in the art understands that communications 135 (such as digitized vocal commands) can be stored on any storage medium, including but not limited to, read only memory chips, random access memory chips, flash memory devices, magnetic storage media, optical storage media, or magneto-optical storage media.

While the present invention has been described in terms of separate functional systems, it will be appreciated by one skilled in the art that multiple functions can be integrated or stacked into chips and circuits.

While the alarm system 100 can be wired into household electrical service, the alarm system 100 can optionally be powered by batteries. Still further, the alarm system 100 can be capable of using either, or both household electrical service and battery power. Optionally the alarm system 100 can further comprise a test mechanism. The test mechanism comprises standard circuitry for device system testing, which is routine to one skilled in the art, along with an interface for a person or machine to activate the test system. Examples of mechanisms for activating the test system include but are not limited to mechanical switches, photoelectric sensors, infra red sensors, motion sensors, sound sensors and digital communications, including wired or wireless communications, activating the alarm function of the external device 125 by pressing its test button, etc. Alternately, the test mechanism can be activated remotely, as from a remote control device or by activating the external device 125.

In addition, the alarm system 100 may be a portable, self contained unit. This allows use when traveling, such as in a hotel or motel, or when a guest in another's home. The system may be placed on the floor near the door so as to detect an alarm in the hallway which may otherwise be too faint to wake the occupant. In such a case, the system may simply listen for a high-pitched tone having a least a certain amplitude and duration, as it may not be practical to active the hotel alarm system for purposes of storing a predetermined signal particular to the hotel alarms in use.

From a reading of the description above of the preferred embodiment of the present invention, modifications and variations thereto may occur to those skilled in the art. Therefore, the scope of the present invention is to be limited only by the claims below.

We claim:

1. An alarm system for use with a structure, comprising:
a motion detector to detect motion in a desired area;
a safety detector to detect a safety condition with respect to the structure;
a transmitter to transmit a communication to a person in a form perceivable by the person; and
a processor functionally connected to the motion detector, the safety detector and the transmitter, and, in response to the safety detector detecting the safety condition, to cause the transmitter to transmit a first said communication to the person in the form perceivable by the person, and, in response to the motion detector detecting motion, to cause the transmitter to perform at least one of transmitting a second said communication to the person in the form perceivable by the person or ceasing transmission of the first said communication.

2. The alarm system of claim 1 wherein the transmitter transmits a tone for at least one of the first said communication or the second said communication.

3. The alarm system of claim 1 wherein the transmitter transmits a plurality of tones for at least one of the first said communication or the second said communication.

4. The alarm system of claim 1 and further comprising:
a receiver to receive an alarm signal from a remote safety device which detects a safety condition; and
wherein the processor is also functionally connected to the receiver, and, in response to the receiver receiving the alarm signal, the processor causes the transmitter to transmit at least one of the first said communication or the second said communication.

5. The alarm system of claim 1 and further comprising:
a receiver to receive an alarm signal from a remote safety device which detects a safety condition; and
wherein the processor is also functionally connected to the receiver, and, in response to the receiver receiving the alarm signal, the processor causes the transmitter to transmit the first said communication, and, in response to the motion detector detecting motion, to cause the transmitter to perform at least one of transmitting the second said communication or ceasing transmission of the first said communication.

6. The alarm system of claim 1 wherein the safety detector detects at least one of smoke, heat carbon monoxide, radon gas, or seismic vibrations.

7. The system of claim 1 wherein at least one of the first said communication or the second said communication is at least one of an audible communication, a visual communication, a vibratory communication, or an olfactory scent.

8. The system of claim 7, wherein the audible communication comprises an audible customized communication.

9. The system of claim 1 wherein at least one of the first said communication or the second said communication is to awaken the person.

10. The system of claim 1 wherein at least one of the first said communication or the second said communication is to alert the person to the safety condition.

11. The system of claim 1 wherein at least one of the first said communication or the second said communication is to provide an instruction to the person.

12. The system of claim 1, wherein the second said communication is an audible customized communication transmitted in response to the motion detector detecting motion.

13. The system of claim 1 wherein the first said communication is an audible communication in a voice of a first person and the second said communication is an audible communication in a voice of a second person.

14. The system of claim 1, wherein the processor causes the transmitter to cease transmitting the first said communication and begin transmitting the second said communication in response to the motion detector detecting motion.

15. The system of claim 1, wherein the processor causes the transmitter to alternate transmitting the first said communication and the second said communication in response to the motion detector detecting motion.

16. The system of claim 1, wherein the transmitter comprises a speaker.

17. The system of claim 1, wherein the system is portable.

18. The system of claim 1 and further comprising a memory, an input device for accepting a user command, and a sound input device for receiving an audible signal from the user; and wherein the processor responds to the command by storing the received audible signal as an audible customized communication in the memory, and wherein the processor causes the transmitter to transmit the audible customized communication as at least one of the first said communication and the second said communication.

19. The system of claim 1 and further comprising a memory having a plurality of stored audible communications, and an input device for accepting a user command; and wherein the processor responds to the command by accepting a user selection of an audible communication from the plurality of stored audible communications; and wherein the processor causes the transmitter to transmit the selected audible communication as at least one of the first said communication or the second said communication.

20. The system of claim 1 and further comprising a memory having a plurality of stored names, and an input device for accepting a user command; and wherein the processor responds to the command by accepting a user selection of a name from the plurality of stored names; and wherein the processor causes the transmitter to transmit the selected name as at least one of the first said communication or the second said communication.

21. The system of claim 1 and further comprising a voice synthesizer to generate a spoken message from a user command, an input device for accepting the user command, and a memory to store at least one of the command and the generated message; and wherein the processor responds to the command by causing the memory to store the at least one of the command or the generated message; and wherein the processor causes the transmitter to transmit the generated message as at least one of the first said communication or the second said communication.

22. The system of claim 21 wherein the user command is a name, the voice synthesizer generates the name as the spoken message, and the transmitter transmits the generated name as at least one of the first said communication or the second said communication.

23. The system of claim 21 wherein the user command is an instruction to the person, the voice synthesizer generates the instruction as the spoken message, and the transmitter transmits the generated instruction as at least one of the first said communication or the second said communication.

24. An alarm system for use with a structure, comprising:

a motion detector to detect motion in a desired area;

a receiver to receive an alarm signal from a remote safety device which detects a safety condition with respect to the structure;

a transmitter to transmit a communication to a person in a form perceivable by the person; and a processor functionally connected to the motion detector, the receiver and the transmitter, and, in response to the receiver receiving the alarm signal, to cause the transmitter to transmit a first said communication to the person in the form perceivable by the person, and, in response to the motion detector detecting motion, to cause the transmitter to perform at least one of transmitting a second said communication to the person in the form perceivable by the person or ceasing transmission of the first said communication.

25. The alarm system of claim 24 wherein the transmitter transmits a tone for at least one of the first said communication or the second said communication.

26. The alarm system of claim 24 wherein the transmitter transmits a plurality of tones for a least one of the first said communication or the second said communication.

27. The system of claim 24 wherein at least one of the first said communication or the second said communication is at least one of an audible communication, a visual communication, a vibratory communication, or an olfactory scent.

28. The system of claim 27, wherein the audible communication comprises an audible customized communication.

29. The system of claim 24 wherein at least one of the first said communication or the second said communication is to awaken the person.

30. The system of claim 24 wherein at least one of the first said communication or the second said communication is to alert the person to a safety problem.

31. The system of claim 24 wherein at least one of the first said communication or the second said communication is to provide an instruction to the person.

32. The system of claim 24, wherein the processor causes the transmitter to transmit at least the first said communication if the received alarm signal corresponds to a predetermined signal.

33. The system of claim 24, wherein the second said communication is an audible customized communication transmitted in response to the motion detector detecting motion.

34. The system of claim 24 wherein the first said communication is an audible communication in the voice of a first person and the second said communication is an audible communication in the voice of a second person.

35. The system of claim 24 and further comprising a memory, and wherein at least one of the first said communication or the second said communication is the stored audible communication is selected from a plurality of stored names in the memory.

36. The system of claim 24 and further comprising a memory and an input device for accepting a user command; and wherein the processor responds to the command by storing a received alarm signal from a remote safety device as a stored signal in the memory, and wherein the processor causes the transmitter to transmit the at least one said communication if a subsequently received alarm signal corresponds to the stored alarm signal.

37. The system of claim 24, wherein the receiver comprises an acoustic transducer to receive the alarm signal.

38. The system of claim 24, wherein the processor causes the transmitter to cease transmitting the first said communication and to begin transmitting the second said communication in response to the motion detector detecting motion.

39. The system of claim 24, wherein the processor causes the transmitter to alternate transmitting the first said communication and the second said communication in response to the motion detector detecting motion.

40. The system of claim 24, wherein the transmitter comprises a speaker.

41. The system of claim 27, wherein the visual communication comprises light.

42. The system of claim 24, wherein the receiver is connected to the remote safety device by means other than via a cable.

43. The system of claim 24, wherein the receiver is functionally connected to the remote safety device via a cable.

44. The system of claim 24, wherein the system is portable.

45. The system of claim 24 and further comprising a memory and an input device for accepting a user command; and wherein the processor responds to the command by storing a received audible signal as an audible customized communication in the memory, and wherein the processor causes the transmitter to transmit the audible customized communication as at least one of the first said communication or the second said communication.

46. The system of claim 45 wherein the receiver receives the received audible signal.

47. The system of claim 45 and further comprising a sound input device for receiving the received audible signal.

48. The system of claim 24 and further comprising a memory and an input device for accepting a user command; and wherein the processor responds to the command by storing a received alarm signal in the memory, and wherein the processor responds to a subsequently received alarm signal by causing the transmitter to transmit the first said communication if the subsequently received alarm signal corresponds to the stored alarm signal.

49. The system of claim 24 and further comprising a memory having a plurality of stored audible communications and an input device for accepting a user command; and wherein the processor responds to the command by accepting a user selection of an audible communication from the plurality of stored audible communications as a selected audible communication; and wherein the processor causes the transmitter to transmit the selected audible communication as the first said communication.

50. The system of claim 24 and further comprising a memory having a plurality of stored audible names, and an input device for accepting a user command; and wherein the processor responds to the command by accepting a user selection of a name from the plurality of stored audible names; and wherein the processor causes the transmitter to transmit the selected name as at least one of the first said communication or the second said communication.

51. The system of claim 24 and further comprising a voice synthesizer to generate a spoken message from a user command, an input device for accepting the user command, and a memory to store at least one of the command and the generated message; and wherein the processor responds to the command by causing the memory to store the at least one of the command and the generated message; and wherein the processor causes the transmitter to transmit the generated message as at least one of the first said communication or the second said communication.

52. The system of claim 51 wherein the user command is a name, the voice synthesizer generates the name as the spoken message, and the transmitter transmits the generated name as the at least one of the first said communication or the second said communication.

53. The system of claim 51 wherein the user command is an instruction to the person, the voice synthesizer generates the instruction as the spoken message, and the transmitter transmits the generated instruction as the at least one of the first said communication or the second said communication.

54. A method for responding to a safety condition with respect to a structure comprising the steps of:

monitoring for a safety condition with respect to the structure;

if the safety condition is detected then transmitting a first communication to a person in a form perceivable by the person;

monitoring for motion by the person; and if the motion is detected then performing at least one of transmitting a second communication to the person in the form perceivable by the person or ceasing transmission of the first said communication.

55. The method of claim 54 wherein at least one of the first said communication or the second said communication includes the name of the person.

56. The alarm system of claim 54 wherein at least one of the first said communication or the second said communication comprises a tone.

57. The alarm system of claim 54 wherein at least one of the first said communication or the second said communication comprises a plurality of tones.

58. The method of claim 54 wherein the step of monitoring for a safety condition comprises monitoring for at least one of smoke, heat carbon monoxide, radon gas, seismic vibrations, or an alarm signal from a remote safety device.

59. The method of claim 54 wherein at least one of the step of transmitting the first communication and the step of transmitting the second communication comprises transmitting at least one of an audible communication, a visual communication, a vibratory communication, or an olfactory scent.

60. The method of claim 54 wherein at least one of the step of transmitting the first communication and the step of transmitting the second communication comprises transmitting a customized audible communication.

61. The method of claim 54 wherein at least one of the step of transmitting the first communication and the step of transmitting the second communication comprises transmitting a communication to awaken the person.

62. The method of claim 54 wherein at least one of the step of transmitting the first said communication or the step of transmitting the second said communication comprises transmitting a communication to alert the person to the safety condition.

63. The method of claim 54 wherein at least one of the step of transmitting the first said communication or the step of transmitting the second said communication comprises providing an instruction to the person.

64. The method of claim 54 and, if the motion is detected, then ceasing transmittal of the first said communication.

65. The method of claim 54 and, if the motion is detected, then alternating transmittal of the first said communication and the second said communication.

66. The method of claim 54 and, prior to the step of monitoring for a safety condition, further comprising the steps of monitoring for a user command and, if the command is detected, then accepting an audible communication and storing the audible communication as a customized audible communication; and wherein at least one of the step of transmitting the first communication or the step of transmitting the second communication comprises transmitting the customized audible communication.

67. The method of claim 54 and, prior to the step of monitoring for a safety condition, further comprising the steps of monitoring for a user command and, if the command is detected, then accepting a user selection of an audible communication from a plurality of stored audible communications as a selected audible communication; and wherein at least one of the step of transmitting the first communication or the step of transmitting the second communication comprises transmitting the selected audible communication.

68. The method of claim 54 and, prior to the step of monitoring for a safety condition, further comprising the steps of monitoring for a user command and, if the command is detected, then accepting a user selection of a name from a plurality of stored audible names; and wherein at least one of the step of transmitting the first communication or the step of transmitting the second communication comprises transmitting the selected name.

69. The method of claim 54 wherein the step of monitoring for a safety condition comprises monitoring for an alarm signal from a remote safety device and, prior to the step of monitoring for a safety condition, further comprising the steps of monitoring for a user command from a user and, if the command is detected, then accepting a received alarm signal and storing the received alarm signal; and transmitting the first communication if a subsequently received alarm signal corresponds to the stored alarm signal.

70. The method of claim 54 and, prior to the step of monitoring for a safety condition, further comprising the steps of monitoring for a user command to generate a voice-synthesized message; and wherein at least one of the step of transmitting the first communication or the step of transmitting the second communication comprises transmitting the synthesized message.

71. The method of claim 70 wherein the user command is a name, and the at least one of the step of transmitting the first communication or the step of transmitting the second communication comprises transmitting the synthesized name.

72. The method of claim 70 wherein the user command is an instruction, and the at least one of the step of transmitting the first communication or the step of transmitting the second communication comprises transmitting the synthesized instruction.

73. A method for responding to a safety condition, comprising the steps of:

monitoring for a user command;

if the command is detected then accepting an audible communication and storing the audible communication as a communication in a first voice;

monitoring for a safety condition;

if the safety condition is detected then transmitting the communication in the first voice to a person in a form perceivable by the person; and transmitting a communication in a second voice to the person in the form perceivable by the person.

74. The method of claim 73 and further comprising ceasing transmission of the communication in the first voice before the transmission of the communication in a second voice is begun.

75. The method of claim 73 wherein the communication in the first voice and the communication in the second voice are alternately transmitted.

76. The method of claim 73 wherein the step of monitoring for a safety condition comprises monitoring for at least one of smoke, heat, carbon monoxide, radon gas, seismic vibrations, or an alarm signal from a remote safety device.

77. The method of claim 73 wherein at least one of the step of transmitting the communication in the first voice or the step of transmitting the communication in the second voice comprises transmitting the name of the person.

78. The method of claim 73 wherein at least one of the step of transmitting the communication in the first voice or the step of transmitting the communication in the second voice comprises transmitting a customized audible communication.

79. The method of claim 73 wherein at least one of the step of transmitting the communication in the first voice or the step of transmitting the communication in to second voice is to awaken the person.

80. The method of claim 73 wherein at least one of the step of transmitting the communication in the first voice or the step of transmitting the communication in the second voice is to alert the person.

81. The method of claim 73 wherein at least one of the step of transmitting the communication in the first voice or the step of transmitting the communication in the second voice is to provide an instruction to the person.

82. A method for responding to a safety condition, comprising the steps of:

monitoring for a user command;

if the command is detected then accepting an audible communication and storing the audible communication as a communication in a second voice;

monitoring for a safety condition;

if the safety condition is detected then transmitting a communication in a first voice to a person in a form perceivable by the person; and transmitting the communication in the second voice to the person in the form perceivable by the person.

83. A method for responding to a safety condition, comprising the steps of:

monitoring for a user command and, if the command is detected, then accepting a received alarm signal and storing the received alarm signal;

monitoring for a safety condition by monitoring an alarm signal from a remote safety device;

if a subsequently received alarm signal corresponds to the stored alarm signal then transmitting a communication in a first voice to a person in a form perceivable by the person; and transmitting a communication in a second voice to the person in the form perceivable by the person.

84. The method of claim 73 and, prior to the step of monitoring for a safety condition, further comprising the steps of monitoring for a user command to generate a voice-synthesized message in at least one of the first voice or the second voice; and wherein the at least one of the step of transmitting the communication in the first voice or the step of transmitting the communication in the second voice comprises transmitting the synthesized message.

85. The method of claim 84 wherein the user command is a name, and the at least one of the step of transmitting the communication in the first voice or the step of transmitting the communication in the second voice comprises transmitting the synthesized name.

86. The method of claim 84 wherein the user command is an instruction, and the at least one of the step of transmitting the communication in the first voice or the step of transmitting the communication in the second voice comprises transmitting the synthesized instruction.

87. An alarm system for use with a structure, comprising:

a safety detector to detect a safety condition with respect to the structure;

a transmitter to transmit a communication to a person in a form perceivable by the person; and a processor functionally connected to the safety detector and the transmitter, and, in response to the safety detector detecting the safety condition, to cause the transmitter to transmit a said communication in a first voice to the person in the form perceivable by the person and then to transmit a said communication in a second voice to the person in the form perceivable by the person.

88. The alarm system of claim 87 wherein the safety detector detects at least one of smoke, heat carbon monoxide, radon gas, seismic vibrations, or an alarm signal from a remote safety device.

89. The system of claim 87 wherein at least one of the communication in the first voice or the communication in the second voice is to awaken the person.

90. The system of claim 87 wherein at least one of the communication in the first voice or the communication in the second voice is to alert the person to the safety condition.

91. The system of claim 87 wherein at least one of the communication in the first voice or the communication in the second voice is to provide an instruction to the person.

92. The system of claim 87, wherein the processor causes the transmitter to cease transmitting the communication in the first voice and begin transmitting the second communication in the second voice.

93. The system of claim 87, wherein the processor causes the transmitter to alternate transmitting the communication in the first voice and the communication in the second voice.

94. The system of claim 87, wherein the transmitter comprises a speaker.

95. The system of claim 87, wherein the system is portable.

96. The system of claim 87 and further comprising a memory and an input device for accepting a user command; and wherein the processor responds to the command by storing a received audible signal, and wherein the processor causes the transmitter to transmit the stored audible signal as the communication in the first voice.

97. The system of claim 96 and further comprising a sound input device for receiving the received audible signal.

98. The system of claim 87 and further comprising a memory and an input device for accepting a user command; and wherein the processor responds to the command by storing a received audible signal, and wherein the processor causes the transmitter to transmit the stored audible signal as the communication in the second voice.

99. The system of claim 98 and further comprising a sound input device for receiving the received audible signal.

100. The system of claim 87 and further comprising a memory, an input device fox accepting a user command, and a sound input device for receiving an alarm signal from the remote safety device; and wherein the processor responds to the command by storing the received alarm signal in the memory, and wherein the processor responds to a subsequently received alarm signal by causing the transmitter to transmit the communication in the first voice if the subsequently received alarm signal corresponds to the stored alarm signal.

101. The system of claim 87 and further comprising a voice synthesizer to generate a spoken message in at least one of the first voice or the second voice from a user command, an input device for accepting the user command, and a memory to store at least one of the command or the generated message; and wherein the processor responds to the command by causing the memory to store the at least one of the command or the generated message; and wherein the processor causes the transmitter to transmit the generated message as at least one of the communication in the first voice or the communication in the second voice.

102. The system of claim 101 wherein the user command is a name, the voice synthesizer generates the name as the spoken message, and the transmitter transmits the generated name as the at least one of the communication in the first voice and the communication in the second voice.

103. The system of claim 101 wherein the user command is an instruction to the person, the voice synthesizer generates the instruction as the spoken message, and the transmitter transmits the generated instruction as the at least one of the communication in the first voice or the communication in the second voice.

* * * * *